US011166558B2

(12) United States Patent
Leach

(10) Patent No.: US 11,166,558 B2
(45) Date of Patent: Nov. 9, 2021

(54) JOINT FOR CHAIR FRAME AND CHAIR INCLUDING A FRAME HAVING THE JOINT AND A SEAT ATTACHED TO THE FRAME

(71) Applicant: Cascade Mountain Technologies, LLC, Issaquah, WA (US)

(72) Inventor: Jeffrey Leach, North Bend, WA (US)

(73) Assignee: CASCADE MOUNTAIN TECHNOLOGIES, LLC, Snoqualmie, WA (US)

( * ) Notice: Subject to any disclaimer, the term of this patent is extended or adjusted under 35 U.S.C. 154(b) by 42 days.

(21) Appl. No.: 16/731,419

(22) Filed: Dec. 31, 2019

(65) Prior Publication Data

US 2021/0196048 A1 Jul. 1, 2021

(51) Int. Cl.

| | |
|---|---|
| ***A47C 4/02*** | (2006.01) |
| ***A47C 4/28*** | (2006.01) |
| ***A47C 4/44*** | (2006.01) |

(52) U.S. Cl.

CPC ..... *A47C 4/44* (2013.01); *A47C 4/02* (2013.01); *A47C 4/286* (2013.01)

(58) Field of Classification Search

CPC ..... A47C 4/02; A47C 4/28; A47C 4/286
See application file for complete search history.

(56) References Cited

U.S. PATENT DOCUMENTS

| | | | | |
|---|---|---|---|---|
| 5,709,428 | A | 1/1998 | Hugghins | |
| 6,637,811 | B2 | 10/2003 | Zheng | |
| 8,205,934 | B2 | 6/2012 | Homans | |
| 8,646,835 | B2 | 2/2014 | Homans et al. | |
| 8,899,686 | B1 | 12/2014 | Kim | |
| D720,954 | S | 1/2015 | Lah | |
| 9,066,593 | B2 | 6/2015 | Homans et al. | |
| 9,066,597 | B2 | 6/2015 | Lee | |
| D745,372 | S | 12/2015 | Peterson | |
| 9,339,115 | B2 | 5/2016 | Lee | |
| 9,351,578 | B2 | 5/2016 | Homans et al. | |
| D775,885 | S | 1/2017 | Lah | |
| 9,554,653 | B2 | 1/2017 | Lee | |
| 2006/0061146 | A1* | 3/2006 | Grace | A47C 4/38 297/16.2 |
| 2012/0104805 | A1* | 5/2012 | Lah | A47C 4/286 297/16.1 |
| 2015/0091352 | A1 | 4/2015 | Lee | |
| 2015/0366352 | A9 | 12/2015 | Homans et al. | |

(Continued)

FOREIGN PATENT DOCUMENTS

| | | | | |
|---|---|---|---|---|
| KR | 20160003567 U | * | 10/2016 | |
| WO | WO-2016055280 A1 | * | 4/2016 | A47C 4/38 |
| WO | WO-2016195400 A1 | * | 12/2016 | A47C 4/286 |

*Primary Examiner* — Timothy J Brindley
(74) *Attorney, Agent, or Firm* — Cozen O'Connor

(57) ABSTRACT

A joint to connect frame members to form a frame of a chair. The joint has a first receptacle to receive a leg in a first position in which the leg extends in a first direction to support the frame of the chair at a distance above a surface, the leg attached to the frame via a cord. The joint has a second receptacle to receive the leg in a second position in which the leg extends in a second direction, opposite to the first direction, so that the joint rests on the surface, the second receptacle having an axially-oriented slot along a sidewall thereof to allow the cord to pass through into a central portion of the second receptacle.

20 Claims, 5 Drawing Sheets

(56) References Cited

U.S. PATENT DOCUMENTS

| | | | | |
|---|---|---|---|---|
| 2015/0374131 | A1* | 12/2015 | Kim | A47C 9/10<br>297/16.1 |
| 2016/0022042 | A1 | 1/2016 | Homans et al. | |
| 2016/0066693 | A1 | 3/2016 | Homans et al. | |
| 2016/0113402 | A1 | 4/2016 | Lee | |
| 2016/0113403 | A1 | 4/2016 | Lee | |
| 2021/0052076 | A1* | 2/2021 | Graybill | A47C 4/03 |

* cited by examiner

JOINT FOR CHAIR FRAME AND CHAIR INCLUDING A FRAME HAVING THE JOINT AND A SEAT ATTACHED TO THE FRAME

BACKGROUND

Technical Field

The present application is directed to a joint for a chair frame and, in particular, a joint having a body with recesses to alternatively receive a leg in respective configurations of the chair frame.

Description of the Related Art

Chairs which are meant to be lightweight and collapsible, such as camp chairs, may be formed of a fabric seat suspended on a frame of metal members and legs connected by joints. Chairs of this type may be used in settings in which it would be useful to have adjustable chair height. To this end, a chair frame may allow the chair legs to be adjusted. In a conventional approach, the elongate chair legs may be folded to an angle of about 90 degrees and secured to the underside of a horizontal member of the chair frame. In such a case, the joints which connect the legs to the chair frame must have an extended portion on an underside thereof to keep the chair frame at a sufficient height to leave room for the folded legs beneath the horizontal member of the chair frame. If a chair is positioned on uneven ground, the space for the folded legs may become obstructed, resulting in uneven positioning of the chair, detachment of the folded legs from the horizontal member, and/or damage to the folded legs.

BRIEF SUMMARY

A joint for a chair frame may be summarized as including a body having a first side, a second side opposed to the first side across a horizontal plane that passes through the body, a first recess that extends into the body from the first side, the first recess dimensioned to receive a proximate end of a first leg of the chair frame in a first configuration of the chair frame, a second recess that extends into the body from the second side, the second recess laterally offset from the first recess, the second recess dimensioned to receive the proximate end of the first leg of the chair frame in a second configuration of the chair frame, the body having a sidewall slot that provides access into an interior of the second recess from an exterior thereof, the slot dimensioned to pass a cord attached to the first leg therethrough in transitioning between the first and the second configurations of the chair frame, the body further including a channel in the first side that extends between to the first recess and the second recess and that is dimensioned to receive the cord attached to the first leg therein in the second configuration of the chair frame, the body further having at least a third recess that extends in a substantially opposed relation to the first recess, the third recess dimensioned to receive a first end of a frame member of the chair frame.

Embodiments of the joint of the chair may include one or more of the following features. The body may include a first tubular portion in which the first recess extends, and at least a second tubular portion in which the second recess extends. The first recess may have a first recess longitudinal axis, the third recess has a third recess longitudinal axis, and the third recess longitudinal axis intersects the first recess longitudinal axis with an obtuse included angle therebetween. The body may further have at least a fourth recess that extends laterally in a diagonal direction with respect to the first and the second recesses, the fourth recess dimensioned to receive a first end of a first lateral frame member of the chair frame. The body may further have at least a fifth recess that extends in a diagonal direction with respect to the first and the second recesses, and in a different direction from the fourth recess, the fifth recess dimensioned to receive a first end of one of a front or a rear frame member of the chair frame. The body may include a first tubular portion in which the first recess extends, a second tubular portion in which the second recess extends, a third tubular portion in which the third recess extends, a fourth tubular portion in which the fourth recess extends, and a fifth tubular portion in which the fifth recess extends. The body may include a number of webs that extend outwardly from at least one of the first, the second or the third tubular portions. The first recess may have a first recess longitudinal axis, the second recess has a second recess longitudinal axis, the third recess has a third recess longitudinal axis, the forth recess has a forth recess longitudinal axis, the fifth recess has a fifth recess longitudinal axis, the second recess longitudinal axis is parallel with the first recess longitudinal axis, the second recess longitudinal axis intersects the first recess longitudinal axis with an obtuse included angle therebetween, and the fifth recess longitudinal axis intersects the forth recess longitudinal axis with an acute included angle therebetween. The fourth and the fifth recesses may each extend in the horizontal plane. The body may include a flange on the on the first side thereof. The channel may have a bottom portion therein to engage a portion of the cord attached to the first leg when the cord is received in the channel in the second configuration of the chair frame. The body may further include a stop located in the first recess to physically engage the proximate end of the first leg of the chair frame in the first configuration. The body may be a unitary, single piece, structure. The body may be a unitary, single piece of plastic.

A chair including a frame and a seat attached to the frame, in which the frame may be summarized as including: a plurality of frame members; a plurality of legs; a plurality of joints, each joint connecting together at least three of the frame members of the plurality of frame members and a respective leg of the plurality of legs, a first joint of the plurality of joints comprising: a body having a first side, a second side opposed to the first side across a horizontal plane that passes through the body, a first recess that extends into the body from the first side, the first recess dimensioned to receive a proximate end of a first leg of the chair frame in a first configuration of the chair frame, a second recess that extends into the body from the second side, the second recess laterally offset from the first recess, the second recess dimensioned to receive the proximate end of the first leg of the chair frame in a second configuration of the chair frame, the body having a sidewall slot that provides access into an interior of the second recess from an exterior thereof, the slot dimensioned to pass a cord attached to the first leg therethrough in transitioning between the first and the second configurations of the chair frame, the body further including a channel in the first side that extends between to the first recess and the second recess and that is dimensioned to receive the cord attached to the first leg therein in the second configuration of the chair frame, the body further having at least a third recess that extends in a substantially opposed relation to the first recess, the third recess dimensioned to receive a first end of a frame member of the chair frame.

A joint to connect frame members to form a frame of a chair may be summarized as including: a first receptacle to receive a leg in a first position in which the leg extends in a first direction to support the frame of the chair at a distance above a surface, the leg attached to the frame via a cord; and a second receptacle to receive the leg in a second position in which the leg extends in a second direction, opposite to the first direction, so that the joint rests on the surface, the second receptacle having an axially-oriented slot along a sidewall thereof to allow the cord to pass through into a central portion of the second receptacle.

Embodiments of the joint to connect frame members to form a frame of a chair may include one or more of the following features. The joint may further comprise a third and a fourth receptacle to receive a first and a second respective frame member. The joint may further comprise a fifth receptacle to receive a frame member to support a seat of the chair. A distal end opening of the first receptacle and a proximal end opening of the second receptacle may meet a bottom surface of the joint. An axial direction of the first receptacle may be parallel to an axial direction of the second receptacle and a distal end opening of the first receptacle and a proximal end opening of the second receptacle may meet a bottom surface of the joint. The bottom surface of the joint may comprise a channel extending between the distal end opening of the first receptacle and the proximal end opening of the second receptacle to receive the cord as the leg is received in the second receptacle.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION

Figure 1:
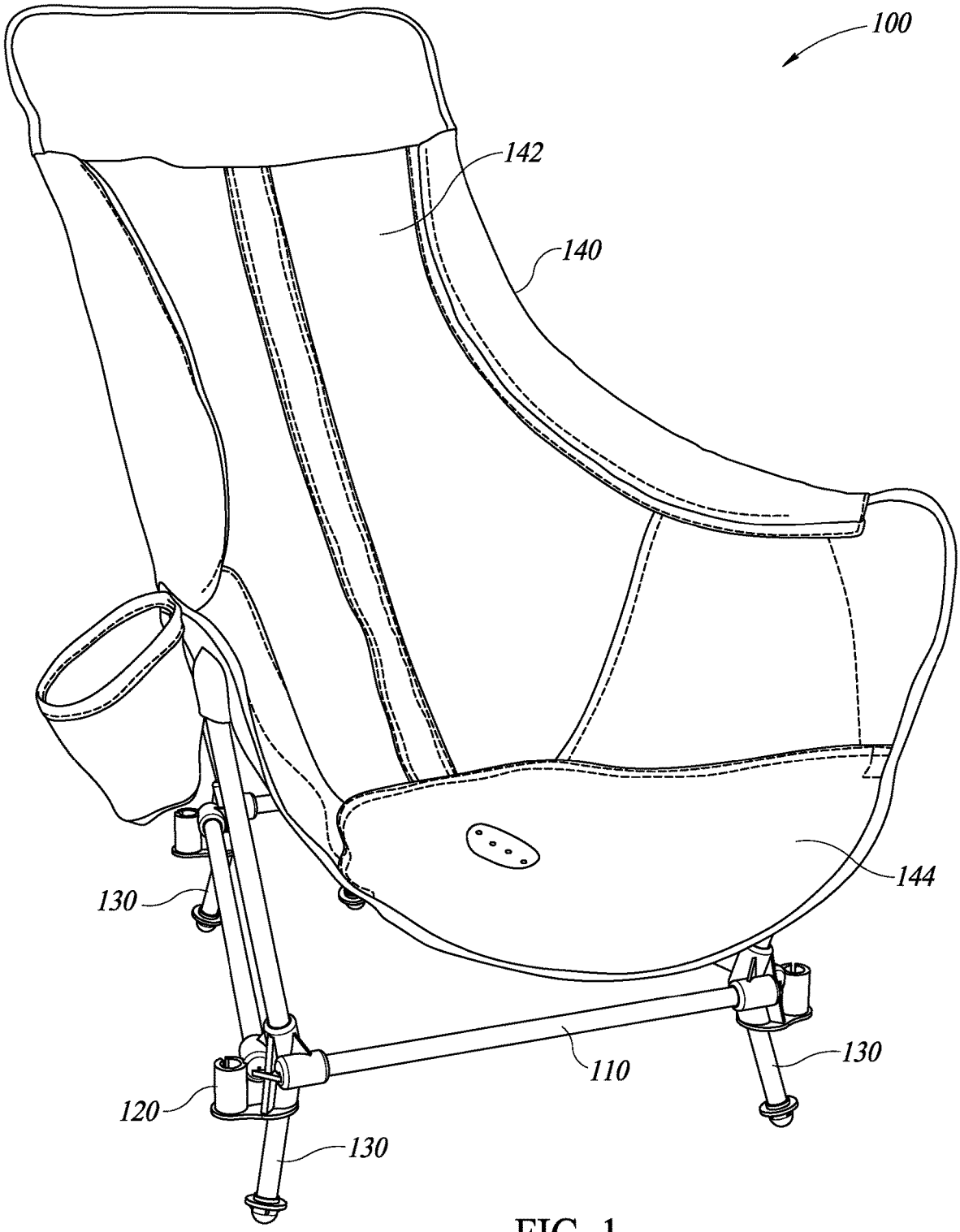
FIG. 1 is an isometric view of a chair having a frame with joints to connect legs to be moveable between two configurations, according to at least one illustrated implementation.

FIG. 1 is an isometric view of a chair 100 having a frame 110 with joints 120 to connect legs 130 to be moveable between two configurations, e.g., a deployed position and a stowed position. In implementations, the chair 100 has a frame 110 and a seat 140 attached to the frame 110 so as to be supported above the frame 110. The seat 140 may be formed by a unitary piece of fabric (e.g., canvas, nylon, etc.) or separate pieces of fabric which are attached, e.g., sewn, together. The seat 140 may have a back portion 142 and a bottom portion 144.

Figure 2:
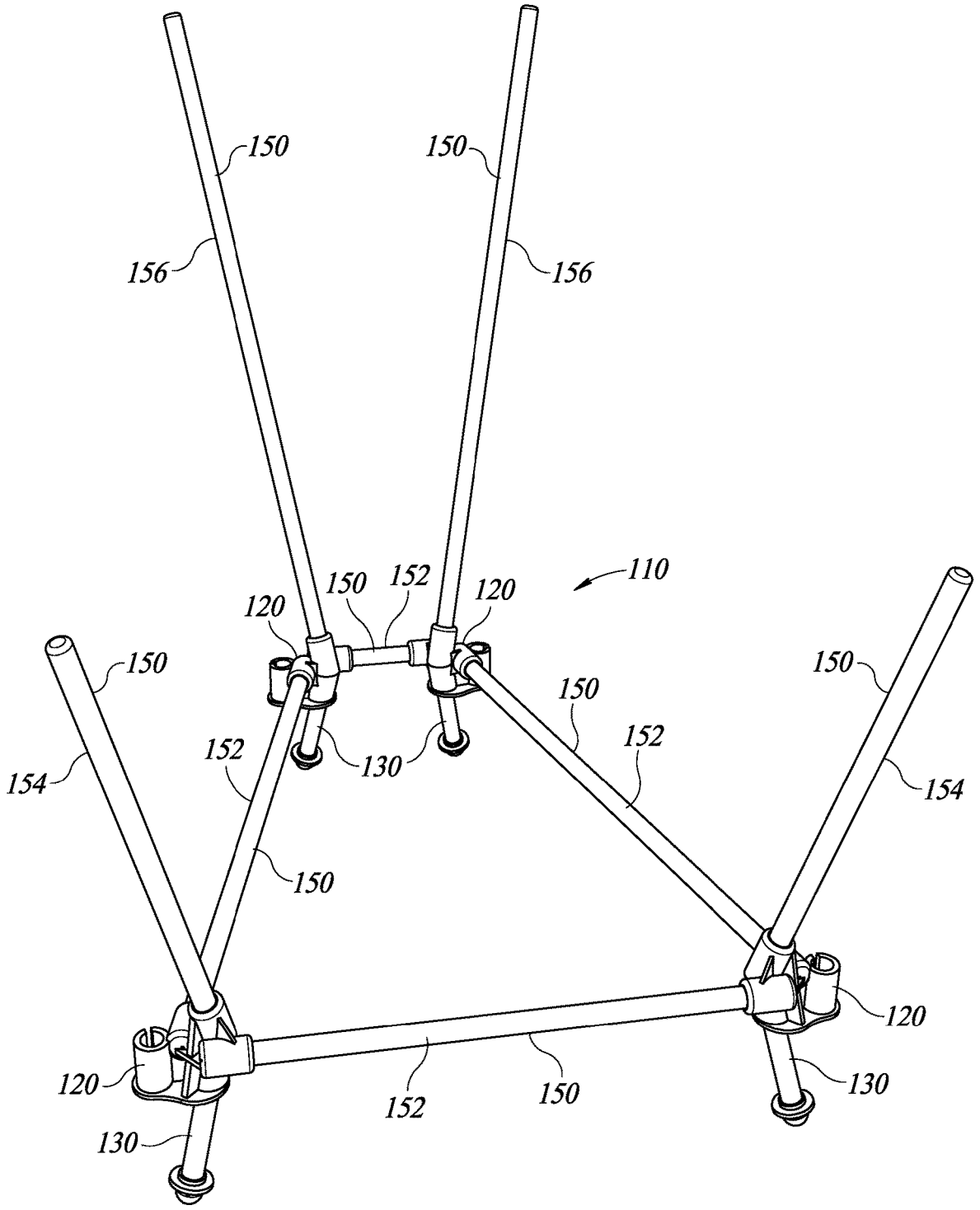
FIG. 2 is an isometric view of a chair frame with a number of frame members and a number legs connected together by a number of joints, according to at least one illustrated implementation.

FIG. 2 is an isometric view of the chair frame 110 with a number of frame members 150 and a number of legs 130 connected together by a number of joints 120, each joint 120 connecting together at least three of the frame members 150 and a respective leg 130. In implementations, the frame members 150 and legs 130 may be hollow, elongate metal, e.g, aluminum, tubes. In the example depicted, the chair 100 has eight frame members 150 and four legs 130. A set of four of the frame members 150 may be, e.g., horizontal frame members 152 which are interconnected to form a quadrilateral in a substantially horizontal plane which is parallel to the ground or other surface upon which the chair 100 may be positioned. Another set of four frame members 154, 156 may extend upward in a substantially vertical direction to support the seat 140 (see FIG. 1). In implementations, the vertically-extending frame members 154, 156 may be at an angle with respect to vertical. For example, the longer vertically-extending frame members 156 which support the back 142 of the seat 140 (see FIG. 1) may be angled to give the seat 140 a reclined orientation. The frame members 150 and legs 130 are joined by a number of joints 120. In implementations, each joint 120 may connected at least three of the frame members 150 and a respective one of the legs 130.

The seat 140 (see FIG. 1) may have openings (not shown) into which vertically-extending frame members 154, 156 are insertable to support the seat 140 on the frame 110 of the chair 100. The seat 140 may have a back portion 142 which is attached to a pair of longer vertically-extending frame members 156 and a bottom portion 144 which is attached to a shorter pair of vertically-extending frame members 154.

Figure 3:
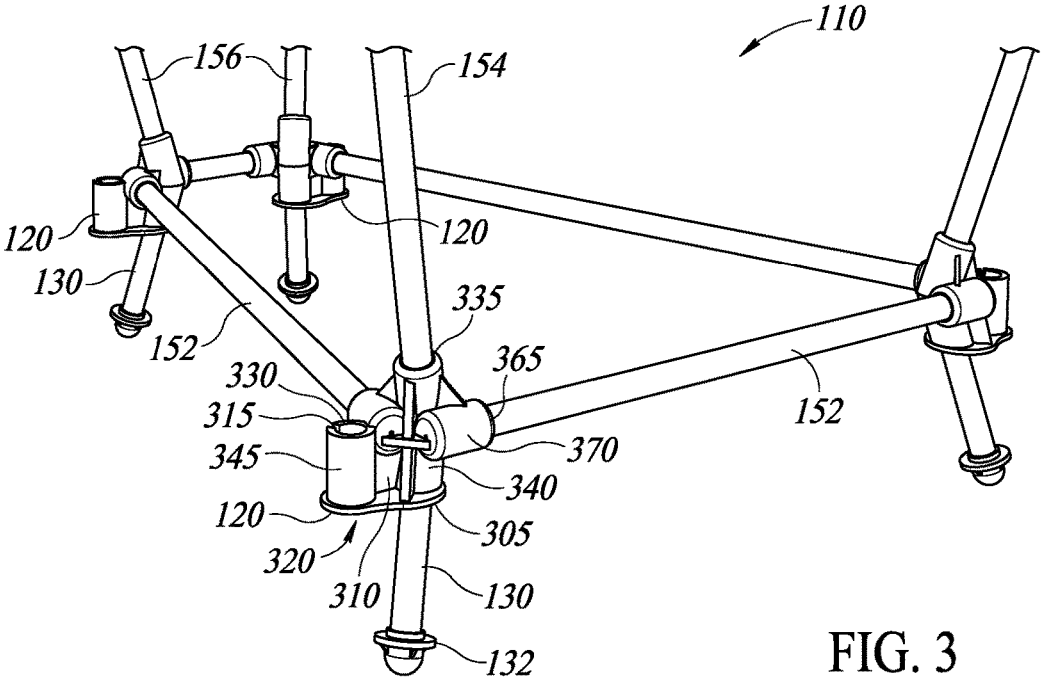
FIG. 3 is an isometric view of the chair frame showing the legs each being received in a first recess of a body of a respective joint, in a first configuration of the chair frame, according to at least one illustrated implementation.
Figure 4:
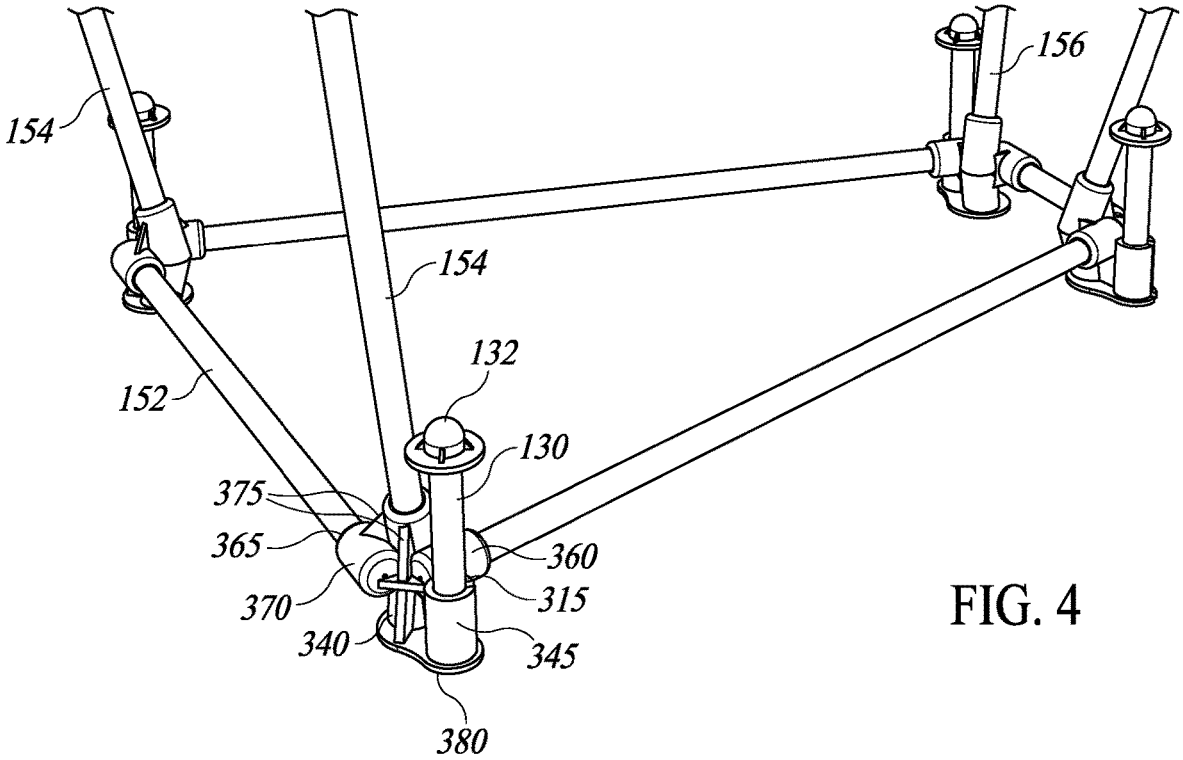
FIG. 4 is an isometric view of the chair frame showing the legs each being received in a second recess of a body of a respective joint, in a second configuration of the chair frame, according to at least one illustrated implementation.

FIG. 3 is an isometric view of the chair frame 110 showing the legs 130 each being received in a first recess 305 (directly visible in the view of FIG. 5) of a body 310 of a respective joint 120, in a first configuration of the chair frame 110. FIG. 4 is an isometric view of the chair frame 110 showing the legs 130 each being received in a second recess 315 of a body 310 of a respective joint 120, in a second configuration of the chair frame 110.

Thus, in implementations, the chair frame 110 may have two configurations. In a first, "deployed," configuration, the legs 130 may extend downward from the chair frame 110 to support the chair frame 110 at a position a distance above the ground or other surface upon which the chair 100 rests. In a second, "stowed," position, the legs 130 may stored in a position in which they extend upward from the chair frame 110, and the joints 120 may support the chair frame 110 at a position just above the ground or other surface. A foot 132 may be formed on, or attached to, a distal end of each leg 130.

The joints 120 may have a unitary, single-piece body formed, e.g., of plastic and may be formed, e.g., in an injection molding process. The body 310 of each joint 120 has a first side 320 and a second side 330 opposed to the first side 320 across a horizontal plane that passes through the body 310. The first recess 305 (see FIG. 5) extends into the body 310 from the first side 320, e.g., the bottom side. The first recess 305 (see FIG. 5) is dimensioned to receive a proximate end of a leg 130 of the chair frame 110 in the deployed configuration of the chair frame 110. A stop (not shown) may be located in the first recess 305 (see FIG. 5) to physically engage the proximate end of the leg 130 of the chair frame 110 in the deployed configuration.

The second recess 315 extends into the body 310 from the second side, e.g., the top side. The second recess 315 is laterally offset from the first recess 305 and is dimensioned to receive the proximate end of the leg 130 of the chair frame 110 in a stowed configuration of the chair frame 110. Thus, in implementations, the longitudinal axes of the first recess 305 and the second recess 315 may be substantially parallel but not coincident, due to the lateral offset between them.

The body 310 may include a third recess 335 that extends in a substantially opposed relation to the first recess 305 (see FIG. 5), i.e., in an upward direction. The third recess 335 is dimensioned to receive a proximal end of a vertically-extending frame member 154, 156 of the chair frame 110, i.e., one of the frame members 150 which supports the seat 140.

The body 310 may include a number of tubular or cylindrical portions, each of which has a recess in the interior thereof. For example, the body 310 may include a first tubular portion 340 in which the first recess 305 extends (i.e., the recess which receives a leg in the deployed configuration), a second tubular portion 345 in which the second recess 315 extends (i.e, the recess which receives a leg in the stowed configuration), and a third tubular portion 350 in which the third recess extends 335 (i.e., the recess which receives a vertically-extending frame member). The longitudinal axis of the first recess 305 may intersect the longitudinal axis of the third recess 335 with an obtuse included angle therebetween.

The body 310 may further include a fourth recess 355 (not visible in FIG. 4), in a fourth tubular portion 360 (not labeled in FIG. 3) of the body 310, that extends, e.g., horizontally, in a diagonal direction with respect to a horizontal line intersecting the first recess 305 and the second recess 315. The fourth recess 355 may be dimensioned to receive a first end of a lateral horizontal frame member 152 of the chair frame 110. The body 310 may further include a fifth recess 365, in a fifth tubular portion 370 of the body, that extends, e.g., horizontally, in a diagonal direction with respect to the horizontal line intersecting the first recess 305 and the second recess 315, and in a different direction from the fourth recess 335. The fifth recess 365 may be dimensioned to receive a first end of one of a front or a rear horizontal frame member 152 of the chair frame 110. In implementations, the longitudinal axis of the fifth recess 365 may intersect the longitudinal axis of the fourth recess 355 with an acute included angle therebetween. The body 310 may include a number of webs 375 (not labeled in FIG. 3) that extend outwardly from one or more of the first, the second or the third tubular portions. The body may have a flange 380 which extends from the bottom side of the body 310.

Figure 5:
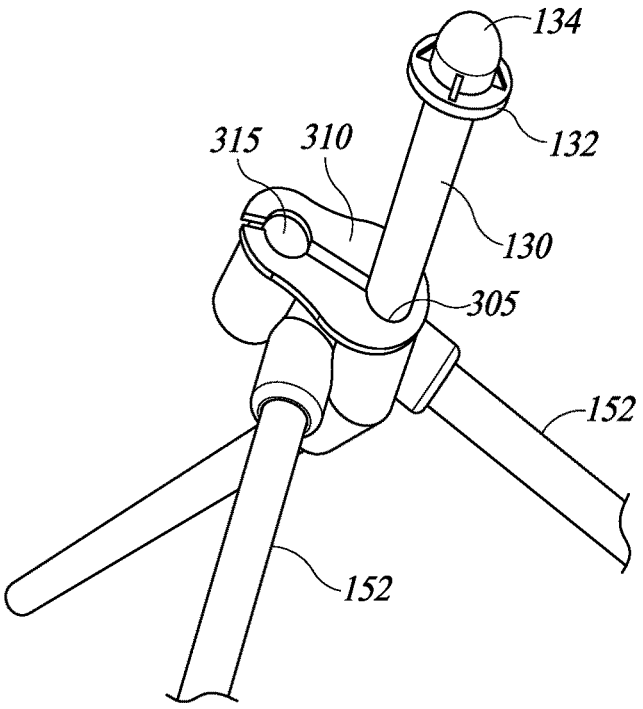
FIG. 5 is an isometric view of a portion of the chair frame showing the body of a joint with a proximate end of a respective leg received in a first recess in a first configuration of the chair frame, according to at least one illustrated implementation.
Figure 6:
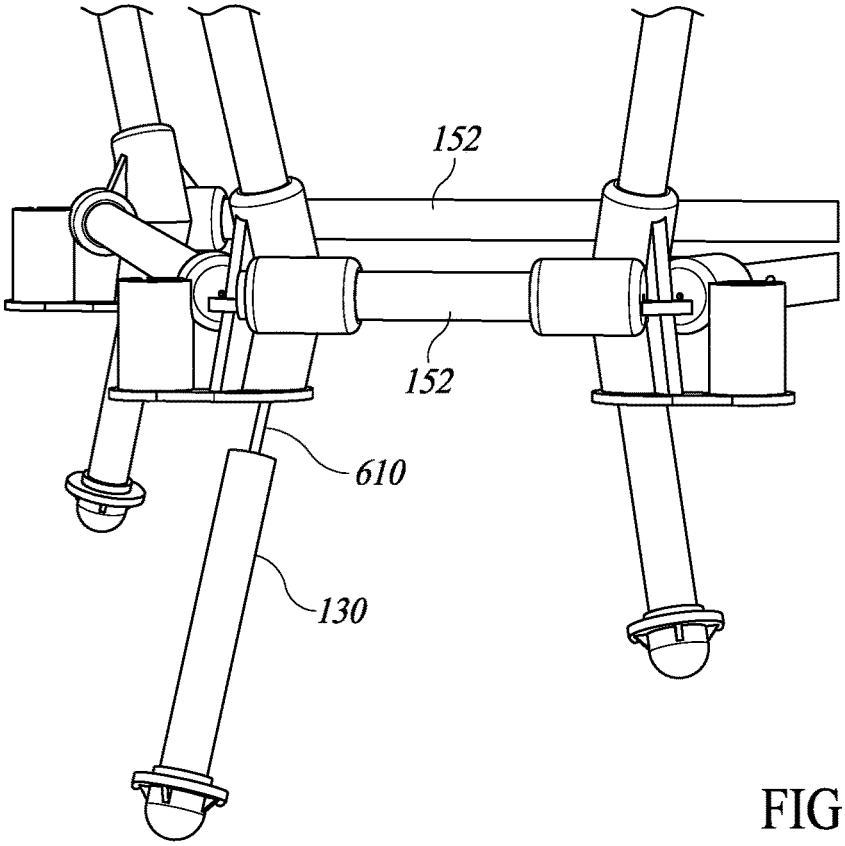
FIG. 6 is an isometric view of a portion of the chair frame showing a respective leg being removed from the first recess of the body of a joint to transition between the first and the second configurations of the chair frame, according to at least one illustrated implementation.

FIG. 5 is an isometric view of a portion of the chair frame 110 showing a first side 320 of the body 310 of a joint 120 with a proximate end of a respective leg 130 received in a first recess 305 which extends into the body 310 in a first configuration of the chair frame 110. FIG. 6 is an isometric view of a portion of the chair frame 110 showing a respective leg 130 being removed from the first recess 305 of the body 310 of a joint 120 to transition between the first and the second configurations of the chair frame.

The legs 130 may be attached to the chair frame by cords 610, e.g., elastic cords such as bungee cords. In implementations, each pair of legs 130 may be interconnected by a cord 610 which passes through the hollow interior of one of the horizontal frame members 152. The cord 610 connecting each pair of legs 130 may extend into the hollow interior portion of leg 130 and be connected at a bottom portion of the leg 130. For example, a foot 132 may be positioned in a opening at the distal end of the tubular structure of each leg 130. The foot 132 may have a bottom portion 134 which is sized and shaped to contact the ground or other surface upon which the chair rests and an upper portion (not shown) disposed inside the hollow, tubular leg 130, which has a protruding structure (not shown), e.g., a loop, hook, etc., to attach an end of the cord 610. In implementations, the cord 610 may extend from an attachment point on a foot 132 positioned at the bottom of a first leg 130, through the hollow interior of the first leg 130, through a first joint 120 connecting the first leg 130 to the chair frame 110, through the hollow interior of one of the horizontal frame members 152 (i.e., a frame member 150 disposed in a horizontal plane), through a second joint 120 connecting a second leg 130 to the chair frame 110, through the hollow interior of the second leg 130, to an attachment point on a foot 132 of the second leg 130.

To change the configuration of the chair from the deployed configuration to the stowed configuration, the user pulls each leg 130 from the first recess 305 of the respective joint 120 (see, e.g., FIG. 5), thereby stretching the elastic cord 610 which holds the leg 130 in the first recess 305 via elastic tension. The leg 130 is positioned by the user to be received and held via elastic tension in the second recess 315, as discussed in further detail below.

Figure 7:
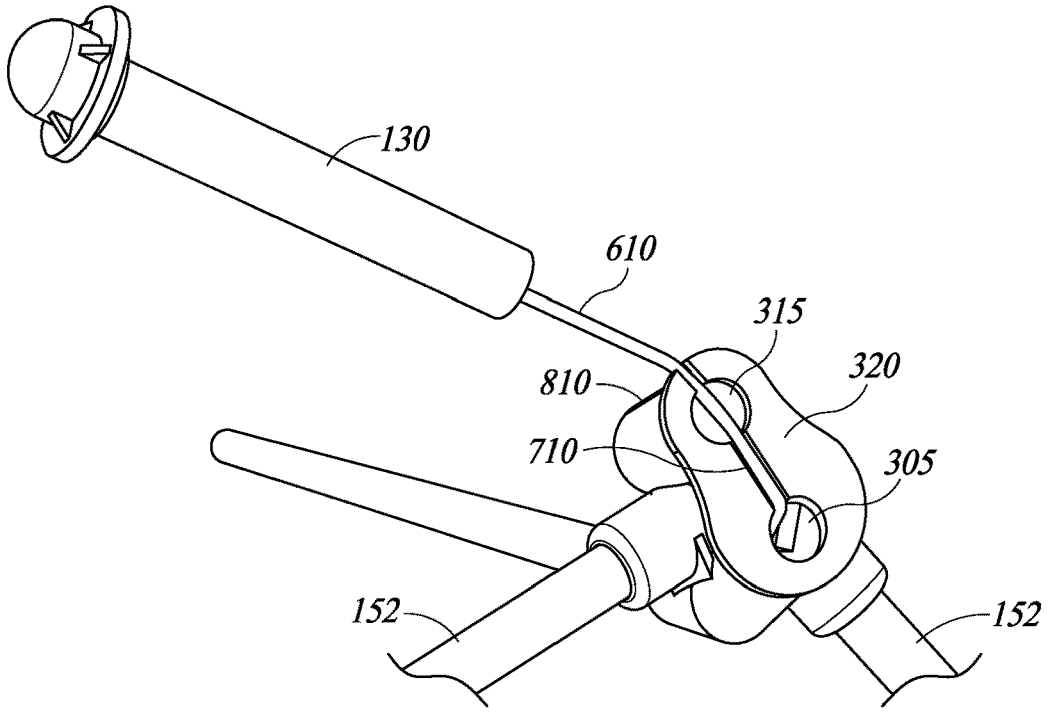
FIG. 7 is an isometric view of a portion of the chair frame showing the body of a joint with a channel that extends between the first recess and the second recess and that is dimensioned to receive the cord attached to the respective leg therein in transitioning between the first and the second configurations of the chair frame, according to at least one illustrated implementation.
Figure 8:
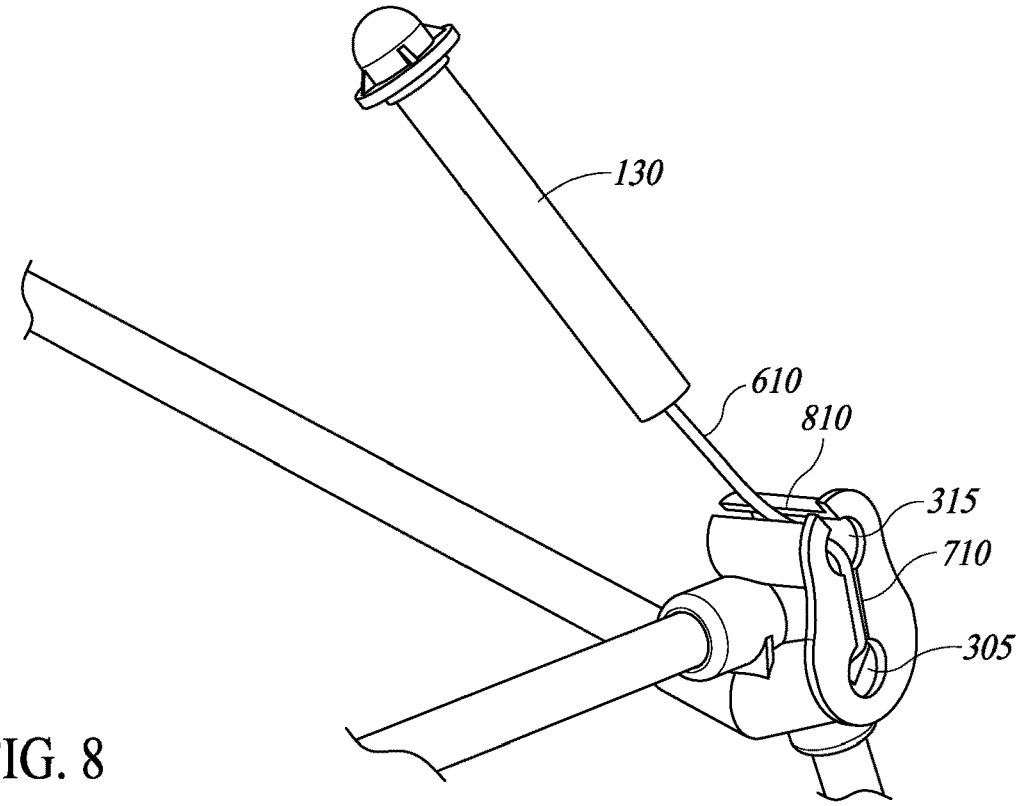
FIG. 8 is an isometric view of a portion of the chair frame showing a sidewall slot that provides access into an interior of the second recess from an exterior thereof, the slot dimensioned to pass the cord attached to the respective leg therethrough in transitioning between the first and the second configurations of the chair frame, according to at least one illustrated implementation.

FIG. 7 is an isometric view of a portion of the chair frame 110 showing the first side 320 of the body 320 of a joint 120 with a channel 710 that extends between the first recess 305 and the second recess 315 and that is dimensioned to receive therein the cord 610 attached to the respective leg 130 in transitioning between the first and the second configurations of the chair frame. FIG. 8 is an isometric view of a portion of the chair frame showing a sidewall slot 810 that provides access into an interior of the second recess 315 from an exterior thereof, the slot 810 dimensioned to pass the cord 610 attached to the respective leg 130 therethrough in transitioning between the first and the second configurations of the chair frame.

To change the configuration of the chair frame 110 from the deployed configuration to the stowed configuration, the user pulls each leg 130 from the first recess 305 of the respective joint 120 (see, e.g., FIG. 5), thereby stretching the elastic cord 620 which holds the leg 130 in the first recess 305 via elastic tension. The leg 130 is moved by the user in an approximately arcuate motion which changes the orientation of the leg 130 in a vertical plate by about 180 degrees. The movement of the leg 130 causes the cord 620 to pass through the sidewall slot 820 into the interior of the second recess 315 so that the leg 130 is in a position to be received in the second recess 315 and held therein via elastic tension when the user releases the leg 130. In embodiments, the second recess 315 may have an opening 820 at a proximal end thereof which is contiguous with an end of the sidewall slot 810 such that the cord 610 runs in a substantially axial direction through the entire length of the second recess 315. These actions may be reversed to change the configuration of the chair frame 110 from the stowed configuration to the deployed configuration.

The various embodiments described above can be combined and/or modified to provide further embodiments in light of the above-detailed description, including the material incorporated by reference. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A joint for a chair frame, comprising:

a body having a first side, a second side opposed to the first side across a horizontal plane that passes through the body, a first recess that extends into the body from the first side, the first recess dimensioned to receive a proximate end of a first leg of the chair frame in a first configuration of the chair frame, a second recess that extends into the body from the second side, the second recess laterally offset from the first recess, the second recess dimensioned to receive the proximate end of the first leg of the chair frame in a second configuration of the chair frame, the body having a sidewall slot that provides access into an interior of the second recess from an exterior thereof, the slot dimensioned to pass a cord attached to the first leg therethrough in transitioning between the first and the second configurations of the chair frame, the body further including a channel in the first side that extends between to the first recess and the second recess and that is dimensioned to receive the cord attached to the first leg therein in the second configuration of the chair frame, the body further having at least a third recess that extends in a substantially opposed relation to the first recess, the third recess dimensioned to receive a first end of a frame member of the chair frame.

2. The joint of claim 1 wherein the body includes a first tubular portion in which the first recess extends, and at least a second tubular portion in which the second recess extends.

3. The joint of claim 1 wherein the first recess has a first recess longitudinal axis, the third recess has a third recess longitudinal axis, and the third recess longitudinal axis intersects the first recess longitudinal axis with an obtuse included angle therebetween.

4. The joint of claim 1 the body further having at least a fourth recess that extends laterally in a diagonal direction with respect to the first and the second recesses, the fourth recess dimensioned to receive a first end of a first lateral frame member of the chair frame.

5. The joint of claim 4, the body further having at least a fifth recess that extends in a diagonal direction with respect to the first and the second recesses, and in a different direction from the fourth recess, the fifth recess dimensioned to receive a first end of one of a front or a rear frame member of the chair frame.

6. The joint of claim 5 wherein the body includes a first tubular portion in which the first recess extends, a second tubular portion in which the second recess extends, a third tubular portion in which the third recess extends, a fourth tubular portion in which the fourth recess extends, and a fifth tubular portion in which the fifth recess extends.

7. The joint of claim 6 wherein the body includes a number of webs that extend outwardly from at least one of the first, the second or the third tubular portions.

8. The joint of claim 6 wherein the first recess has a first recess longitudinal axis, the second recess has a second recess longitudinal axis, the third recess has a third recess longitudinal axis, the forth recess has a forth recess longitudinal axis, the fifth recess has a fifth recess longitudinal axis, the second recess longitudinal axis is parallel with the first recess longitudinal axis, the second recess longitudinal axis intersects the first recess longitudinal axis with an obtuse included angle therebetween, and the fifth recess longitudinal axis intersects the forth recess longitudinal axis with an acute included angle therebetween.

9. The joint of claim 4 wherein the fourth and the fifth recesses each extend in the horizontal plane.

10. The joint of claim 1 wherein the body includes a flange on the first side thereof.

11. The joint of claim 1 wherein the channel has a bottom portion therein to engage a portion of the cord attached to the first leg when the cord is received in the channel in the second configuration of the chair frame.

12. The joint of claim 1 wherein the body further includes a stop located in the first recess to physically engage the proximate end of the first leg of the chair frame in the first configuration.

13. The joint of claim 1 wherein the body is a unitary, single piece, structure.

14. The joint of claim 1 wherein the body is a unitary, single piece of plastic.

15. A chair comprising a frame and a seat attached to the frame, the frame comprising:

a plurality of frame members;

a plurality of legs;

a plurality of joints, each joint connecting together at least three of the frame members of the plurality of frame members and a respective leg of the plurality of legs, a first joint of the plurality of joints comprising:

a body having a first side, a second side opposed to the first side across a horizontal plane that passes through the body, a first recess that extends into the body from the first side, the first recess dimensioned to receive a proximate end of a first leg of the chair frame in a first configuration of the chair frame, a second recess that extends into the body from the second side, the second recess laterally offset from the first recess, the second recess dimensioned to receive the proximate end of the first leg of the chair frame in a second configuration of the chair frame, the body having a sidewall slot that provides access into an interior of the second recess from an exterior thereof, the slot dimensioned to pass a cord attached to the first leg therethrough in transitioning between the first and the second configurations of the chair frame, the body further including a channel in the first side that extends between to the first recess and the second recess and that is dimensioned to receive the cord attached to the first leg therein in the second configuration of the chair frame, the body further having at least a third recess that extends in a substantially opposed relation to the first recess, the third recess dimensioned to receive a first end of a frame member of the chair frame.

16. A joint to connect frame members to form a frame of a chair, the joint comprising:

a first receptacle to receive a leg in a first position in which the leg extends in a first direction to support the frame of the chair at a distance above a surface, the leg attached to the frame via a cord; and a second receptacle to receive the leg in a second position in which the leg extends in a second direction, opposite to the first direction, so that the joint rests on the surface, the second receptacle having an axially-oriented slot along a sidewall thereof to allow the cord to pass through into a central portion of the second receptacle.

17. The joint of claim 16, further comprising a third and a fourth receptacle to receive a first and a second respective frame member.

18. The joint of claim 16 wherein a distal end opening of the first receptacle and a proximal end opening of the second receptacle meet a bottom surface of the joint.

19. The joint of claim 16 wherein an axial direction of the first receptacle is parallel to an axial direction of the second receptacle and a distal end opening of the first receptacle and a proximal end opening of the second receptacle meet a bottom surface of the joint.

20. The joint of claim 19 wherein the bottom surface of the joint comprises a channel extending between the distal end opening of the first receptacle and the proximal end opening of the second receptacle to receive the cord as the leg is received in the second receptacle.

* * * * *